United States Patent [19]

Martin

[11] Patent Number: 4,913,672

[45] Date of Patent: Apr. 3, 1990

[54] ANCHOR FOR BEACH AIR MATTRESSES OR RAFTS

[76] Inventor: Stephen A. Martin, 11500 Summit West Blvd., Apt. 30-C, Tampa, Fla. 33617

[21] Appl. No.: 211,877

[22] Filed: Jun. 16, 1988

[51] Int. Cl.[4] ..... B63B 21/00

[52] U.S. Cl. ..... 441/40; 441/129; 114/294

[58] Field of Search ..... 441/129, 40; 114/294

[56] References Cited

U.S. PATENT DOCUMENTS

| | | | |
|---|---|---|---|
| 1,148,924 | 8/1915 | Paradise | 114/294 |
| 3,793,845 | 2/1974 | Keith | 114/294 |
| 4,004,625 | 1/1977 | Zietlow | 114/294 |
| 4,729,331 | 3/1988 | Eggleston | 114/294 |
| 4,775,346 | 10/1988 | Gunter et al. | 441/129 |

FOREIGN PATENT DOCUMENTS

| | | | |
|---|---|---|---|
| 214488 | 12/1983 | Japan | 114/294 |

*Primary Examiner*—Sherman D. Basinger
*Assistant Examiner*—Stephen P. Avila

[57] ABSTRACT

A storage pocket formed to enclose a portable flexible anchor bag. The storage pocket is of a vinyl material with brass eyelets mounted at its top corners for connecting to a flotation device with a closure flap for holding bag inside. The anchor bag is formed of a flexible vinyl with a draw string rope sewn in at the top folded over portion of the open end of the bag. With brass eyelets mounted adjacent and parallel at the top edge at the open end of the outside portion of the flap. The draw string tether sewn into the top folded over flap will be knotted at one end to prevent the slipping of the draw string.

6 Claims, 1 Drawing Sheet

ANCHOR FOR BEACH AIR MATTRESSES OR RAFTS

SUMMARY OF THE INVENTION

It is therefore the main object of this Invention to show that a sand filled bag that can be folded into a bight and stored into a pocket that is made for beach type air mattresses and the like or rafts that can carry one or more persons. It is a further object of the invention to demonstrate the dire need for an anchor for recreational air mattresses and rafts, that is portable and easily stored. It is widly known that using flotation devices on the Gulf, Ocean, or even large lakes that the flotation devices without an anchor can be taken away by Gulf or Ocean currents, winds, or even on lakes where there are boats that can cause waves that will move your flotation device hundreds of feet from its original position. Another object of the invention is to show that having an anchor for air mattresses and rafts far outweighs the advantages of not having anchoring means for flotation devices. The anchoring means of the present invention can also provide a safety element not widely thought of. With said anchor filled with sand holding the air mattresses or raft in place will eliminate unnecessary splashing trying to keep the flotation device in place. This unnecessary splashing in Ocean or Gulf waters could attract predators of the sea such as sharks.

BACKGROUND OF THE INVENTION

1. Field of the Invention

This invention relates generally to an anchor for an inflatable beach-type mattress or rafts, which more particularly the anchor comprises a plastic or canvas bag which is flexible, having a draw string opening which may be filled with a substance heavier than water preferably sand. An anchor line connects the anchor bag to the mattress or raft. The mattress or raft includes a pouch or pocket for storing the anchor during non-use.

2. Description of Related Art

The primary object of the present invention is to provide anchoring means for beach type air mattresses or rafts. Using an anchor is not new but using an anchor that is portable and can be folded and stored in a small pocket on beach flotation devices or rafts that carry more than one person is different from prior art.

As was uncovered in a patent search James Dolan Jr. U.S. Pat. No. 3,802,007 Buoyant Support for Christmas tree, Dolan uses a solid container which sand was put into to hold the tree in place. This container is solid and not easily stored. As in Barry N. Roberts U.S. Pat. No. 4,654,906, sand is used in pockets for out of water beach blankets and has no bearing on anchors for use on devices such as beach floats and rafts.

DETAILED DESCRIPTION OF THE INVENTION

Figure 1:
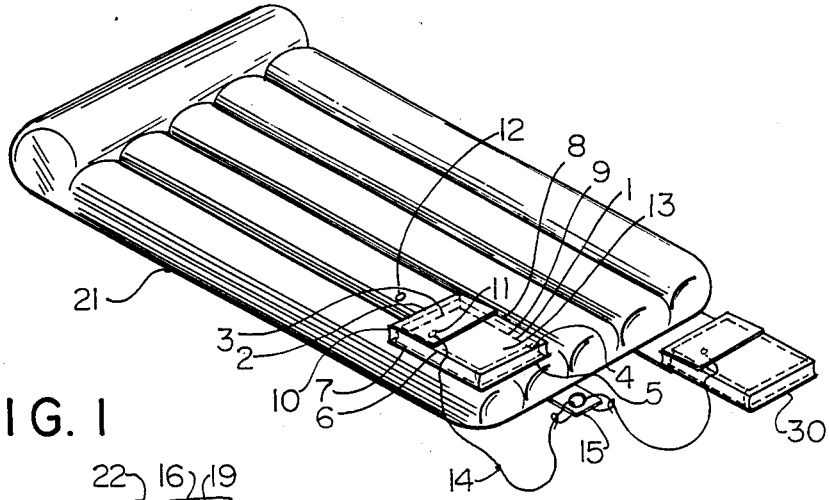
FIG. 1 is a perspective view of the Air Mattress with the anchor pocket integrally constructed in the Air Mattress.

The invention comprises of an air mattress FIG. 1 member 21 with a pocket integrally made for the air mattress 21. The pocket member 1 is so constructed with edges members 2-3 and bottom edges members 4-5. The parallel edges 6-7 8-9 and a closure flap member 10 is constructed with snap ring clamps 11 and 12 to hold draw string anchor bag 13 inside. The anchor bag member 13 is folded into a bight and connected to said anchor line member 14. The anchor line 14 is connected to eyelet flap ring member 15. The draw string anchor bag FIG. 2 member 16 shown outside of pocket member 1 FIG. 1 has a sewn in anchor line member 17 attached to eyelet flap ring 15. The draw string member 17 is threaded through eyelet 18-19 respectively. The anchor bag 16 is so constructed that when the anchor is filled with sand from the beach member 20 the draw string member 17 can be pulled to close anchor bag top member 16. This draw string member 17 provides means of easily closing the top of anchor bag 16 and will stay closed when put into the water. In eyelet 19 there will be a knot tied in anchor line—draw string line 17 at eyelet member 19 the knot will keep draw string line in place. This knot at eyelet 19 will allow the bag to be closed at FIG. 2 member 16.

Figure 2:
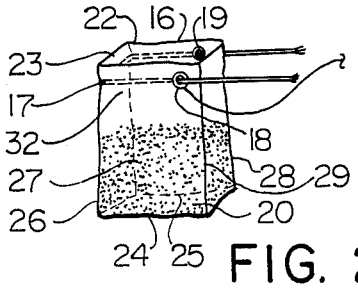
FIG. 2 is a perspective view of the Draw String Anchor Bag filled with sand.
Figure 3:
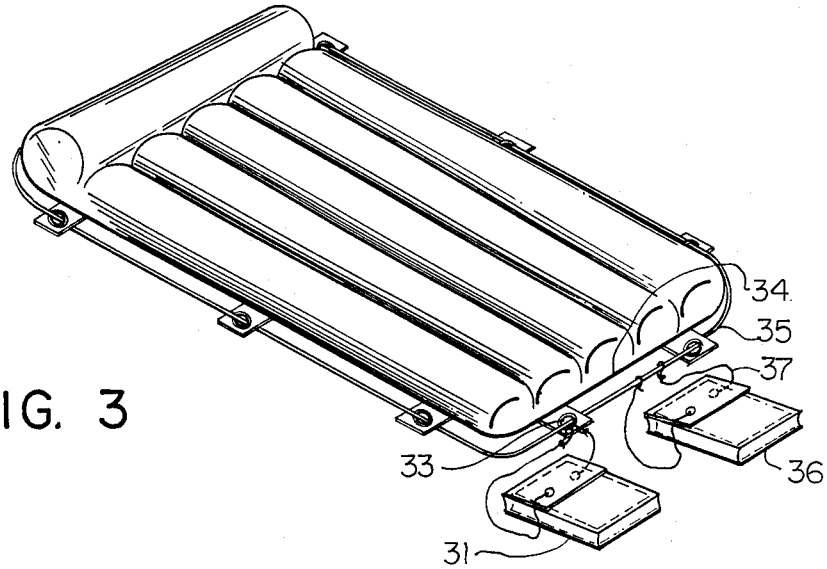
FIG. 3 is a top perspective view of two alternative connections for connecting the Anchor Bag to the air mattress.

The anchor bag FIG. 2 member 16 is constructed of a material such as canvas or vinyl so as to allow the draw string member 17 close anchor bag top member 16. The anchor bag is constructed with top edges 22-23 and bottom edges members 24-25. The parallel edges includes members 26-27, and 28-29 respectively. The bag is constructed with brass eyelets members 18-19. The anchor bag 16 is so constructed so that the top edges 22-23 are folded down and sewn so as to form an envelope 32 which will allow the anchor line draw string member 17 to be threded through eyelet 18 and a knot tied at eyelet 19. This will allow the draw string 17 to close anchor bag 16. The anchor bag pocket member 30 FIG. 1 shows another means of constructing the raft 21 and pocket 30 in a complete unit. In FIG. 3 pocket member 31 is attached to an eyelet ring 33 of raft 34. The outside perimeter rope member 35 is used for connecting anchor pocket 36 to raft perimeter rope 35. This allows anchor pocket 36 to be separate from raft 34, or it allows anchor pocket member 31 and 36 to be attached to air mattress 34. Pocket member 31 is connected to eyelet ring 33 by a snap hook to raft 34. The anchor pocket 36 is connected to the perimeter rope 35 by a small length of rope member 37. This allows a versatile attachment arrangement means for the anchor pockets members 1-30-31-36.

While the invention has been shown and described herein in what is concieved to be the most practical and preferred embodiment, it is recongnized that departures may be made therefrom within the scope of the invention, which is therefore not to be limited to the details disclosed herein, but is to be afforded the full scope of the claims so as to embrace any and all equivalent apparatus and articles.

I claim:

1. An achoring apparatus for attachment to a flotation device used on lakes or ocean waters comprising:

storage pocket means constructed integrally with the floatation device for storage of a flexible anchor bag;

said flexible anchor bag constructed of a flexible material to be filled with a substance heavier than water;

connecting means to the floatation device consisting of brass eyelets mounted to an outside perimeter flap of the flotation device allowing the tying of such storage pocket to the flotation device by means of small lengths of rope;

draw string at the top of the anchor bag which said draw string is sewn into a folded over portion at the top of said anchor bag with brass eyelets installed so as to allow the threading of said anchor draw string through the brass eyelets allowing one end to be knotted to prevent slippage of said draw string;

a tether connected to said anchor bag which is tied to such floatation device by means of brass eyelet mounted to the outside perimeter flap whereby the anchor bag tether can be coupled to the flotation device.

2. An anchor apparatus as set forth 1 wherein:

said anchor bag is constructed of vinyl and is of a rectangular form with an opening at one end.

3. An anchor apparatus as set forth in claim 1 wherein:

said storage pocket means is formed of vinyl.

4. An anchor apparatus as set forth in claim 1 wherein:

said connecting means uses brass eyelets mounted to said outside perimeter flap of said flotation device allowing the tying of said storage pocket to said floatation device.

5. An anchor apparatus as set forth in claim 1 wherein:

said storage pocket is constructed with brass eyelets to allow the coupling of said anchor bag storage pocket to said floatation device.

6. An anchor apparatus as set forth in the claim 1 wherein:

said draw string at the top of said anchor bag is sewn into the folded over portion at the top of said anchor bag with two brass eyelets attached adjacent and parallel in the outer portion of said top flap allowing said folded over flap to be sewn at the bottom edge whereby said draw string sewn into top flap will be knotted at one end to prevent slippage.

* * * * *